US010823423B2

(12) United States Patent
Westrude et al.

(10) Patent No.: US 10,823,423 B2
(45) Date of Patent: Nov. 3, 2020

(54) METHOD OF AESTHETIC ENHANCEMENT

(71) Applicants: Phillip J. Westrude, Lakeville, MN (US); Anthony T. Westrude, Prior Lake, MN (US)

(72) Inventors: Phillip J. Westrude, Lakeville, MN (US); Anthony T. Westrude, Prior Lake, MN (US)

( * ) Notice: Subject to any disclaimer, the term of this patent is extended or adjusted under 35 U.S.C. 154(b) by 72 days.

(21) Appl. No.: 16/186,750

(22) Filed: Nov. 12, 2018

(65) Prior Publication Data

US 2019/0120494 A1 Apr. 25, 2019

Related U.S. Application Data

(62) Division of application No. 14/866,906, filed on Sep. 26, 2015, now Pat. No. 10,125,994.

(60) Provisional application No. 62/071,509, filed on Sep. 26, 2014.

(51) Int. Cl.

| | |
|---|---|
| ***F24B 1/191*** | (2006.01) |
| ***F24B 1/18*** | (2006.01) |
| ***F24C 3/00*** | (2006.01) |

(52) U.S. Cl.

CPC ..... *F24B 1/191* (2013.01); *F24B 1/1808* (2013.01); *F24C 3/006* (2013.01)

(58) Field of Classification Search

CPC ..... F24B 1/191; F24B 1/1808; F24B 1/198; F23C 3/006; B05B 17/08

See application file for complete search history.

(56) References Cited

U.S. PATENT DOCUMENTS

| | | | |
|---|---|---|---|
| 2,109,255 | A | 2/1938 | Mapson |
| 2,120,653 | A | 6/1938 | Sliger |
| 3,830,217 | A | 8/1974 | Maness |
| 4,572,598 | A | 2/1986 | Moore, Jr. |
| 5,184,886 | A | 2/1993 | Handley et al. |

FOREIGN PATENT DOCUMENTS

| | | |
|---|---|---|
| GB | 2418517 | 3/2006 |
| JP | 2008107010 | 5/2008 |

OTHER PUBLICATIONS

Rainforest Cafe Bar Web Page; http://www.flickr.com/photos/lizcroteau/177300716/; Mar. 19, 2013.

*Primary Examiner* — Alfred Basichas

(74) *Attorney, Agent, or Firm* — Richard John Bartz

(57) ABSTRACT

An apparatus and method for aesthetic enhancement of indoor and outdoor living spaces combines fire, bubbling water and light reflection to foster enjoyment and relaxation. Wall assemblies having glass panes are spaced apart from each other to provide a chamber to hold water separate from a burner assembly. Air pumped into the water forms air bubbles in the water. A LED light strip illuminates the water, bubbles and glass panes in changing colors.

18 Claims, 8 Drawing Sheets

METHOD OF AESTHETIC ENHANCEMENT

CROSS REFERENCE TO RELATED APPLICATION

This application is a division of U.S. patent application Ser. No. 14/866,906 filed Sep. 26, 2015. U.S. patent application Ser. No. 14/866,906 claims the priority of U.S. Application Ser. No. 62/071,509 filed Sep. 26, 2014.

FIELD OF THE INVENTION

The invention is in the field of devices and methods for aesthetically enhancing living spaces characterized by water, fire, air bubbles and light.

BACKGROUND OF THE INVENTION

It is desirable to create atmosphere and ambience associated with a particular place, person or thing useable in outdoor and indoor living spaces. Backyard fires are a part of summer and are enjoyable and relaxing. Fire extends outdoor living seasons beyond the summer months by warming outdoor spaces. Fire tables having a visual flame that moves on top of a bed of fire glass are known to enhance the décor of outdoor patios, backyards and commercial establishments transforming these areas into warm and entertaining settings.

SUMMARY OF THE INVENTION

The aesthetic enhancement apparatus for a living space has a frame member adapted to be mounted on a support surface such as a table top. A first wall assembly and a second wall assembly laterally spaced from the first wall assembly are joined to the frame member to define a chamber for holding a liquid. A sealant located on adjacent end portions of the first and second wall assemblies and the frame member functions to prevent leakage of liquid from the chamber. The apparatus has a burner assembly mounted on the frame member which is surrounded by the first wall assembly. A tube member connected to an air supply is located in the chamber whereby air from the air supply is released into the liquid in the chamber to form air bubbles in the liquid. A light source connected to a power supply located in the chamber is operable to illuminate the first and second wall assemblies, air bubbles in the chamber and liquid in the chamber to create ambience and a relaxing atmosphere in the living space.

DESCRIPTION OF THE INVENTION

In the following detailed descriptions of the aesthetic enhancement apparatus, reference is made to the accompanying drawing that form a part hereof, and in which are shown, by way of illustration, specific embodiments in which the invention may be practiced. It is to be understood that other embodiments may be utilized and structure changes may be made or other method steps and sequence thereof may be used without departing from the scope of the present invention. The aesthetic enhancement apparatus is herein described as used in indoor and outdoor environments. The aesthetic enhancement apparatus can have uses other than aesthetic enhancement uses.

Figure 1:
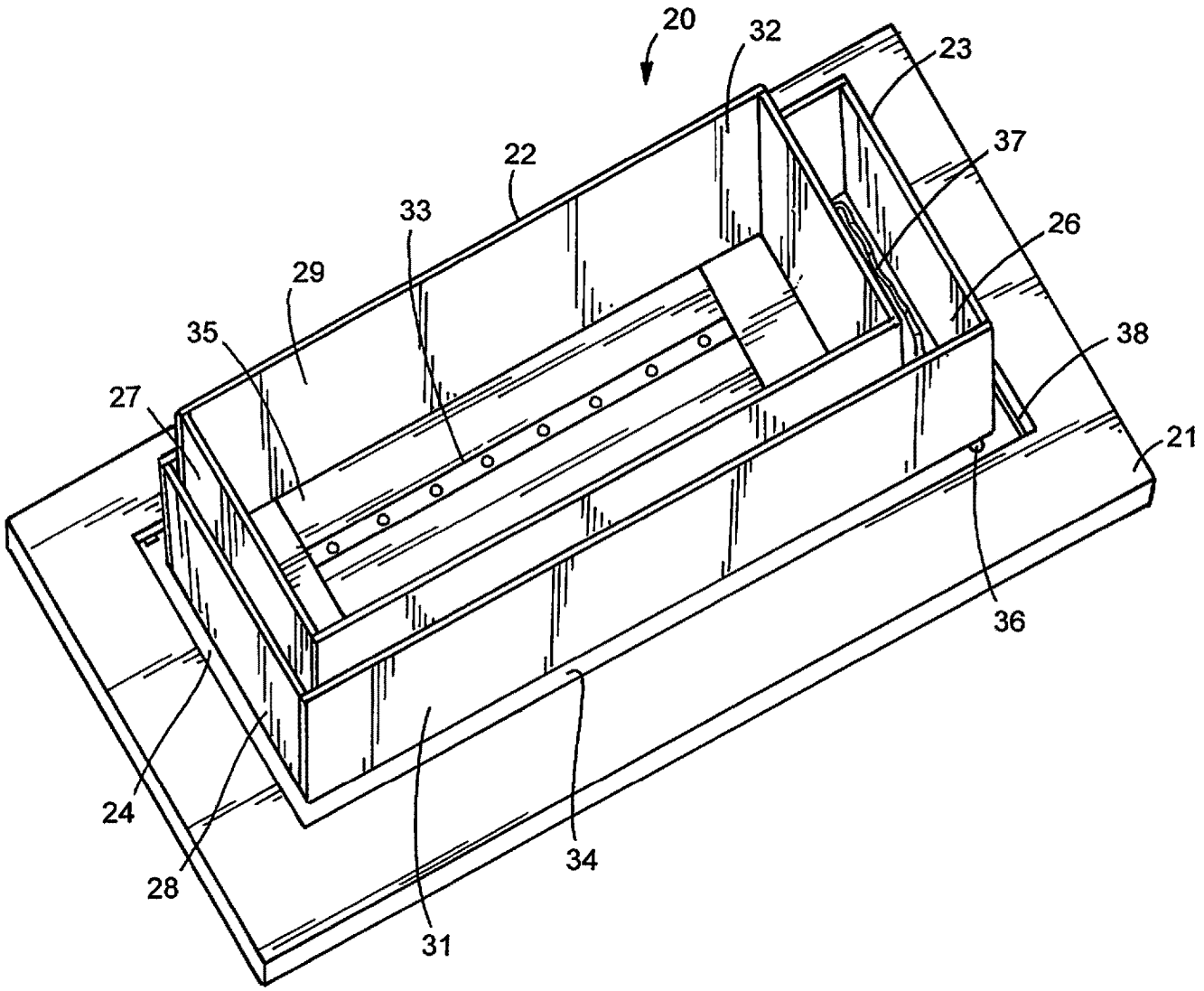
FIG. 1 is a perspective view of an aesthetic enhancement apparatus of the invention mounted on a table top.
Figure 2:
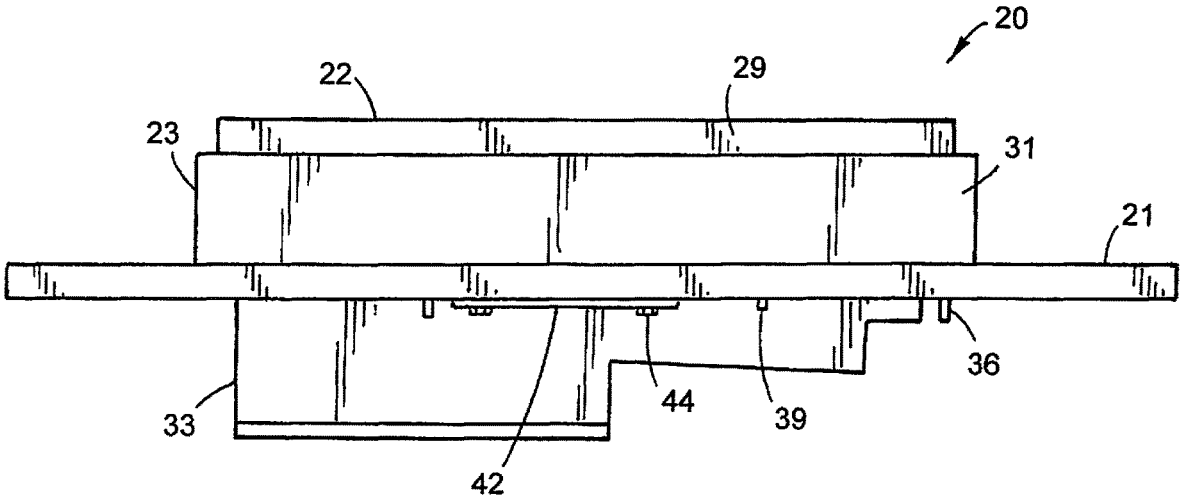
FIG. 2 is an elevated front plan view of FIG. 1.
Figure 3:
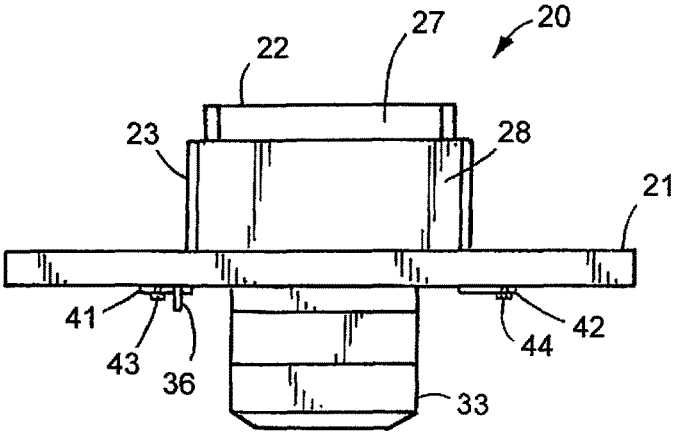
FIG. 3 is an elevated side view of FIG. 1.
Figure 4:
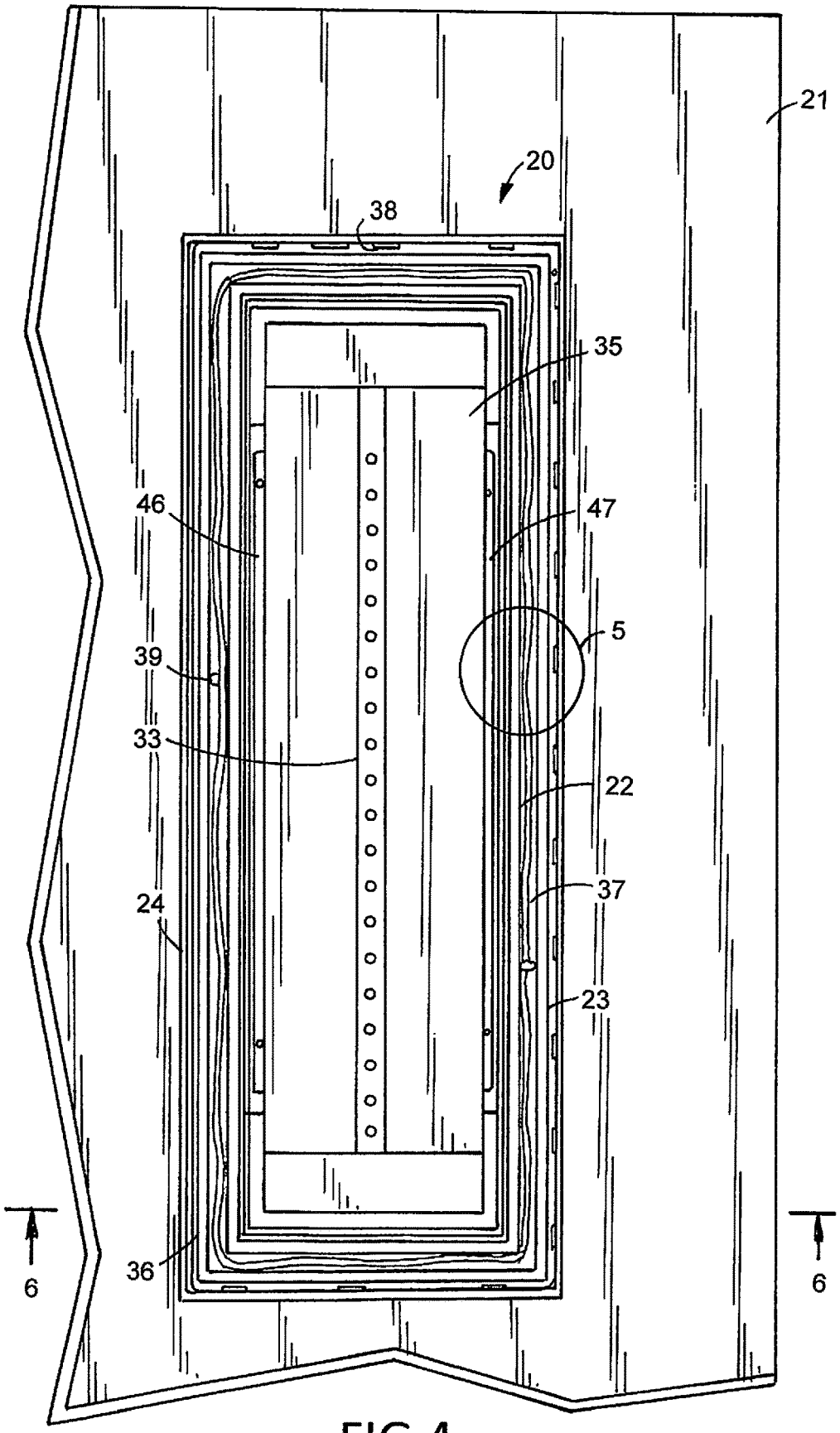
FIG. 4 is a top plan view of FIG. 1.
Figure 5:
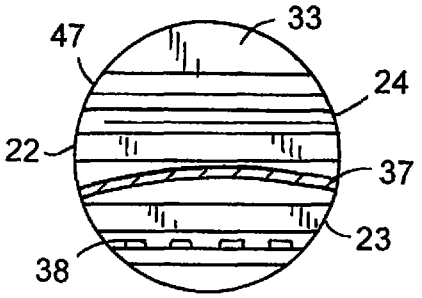
FIG. 5 is an enlarged sectional view of Area 5 of FIG. 4.
Figure 6:
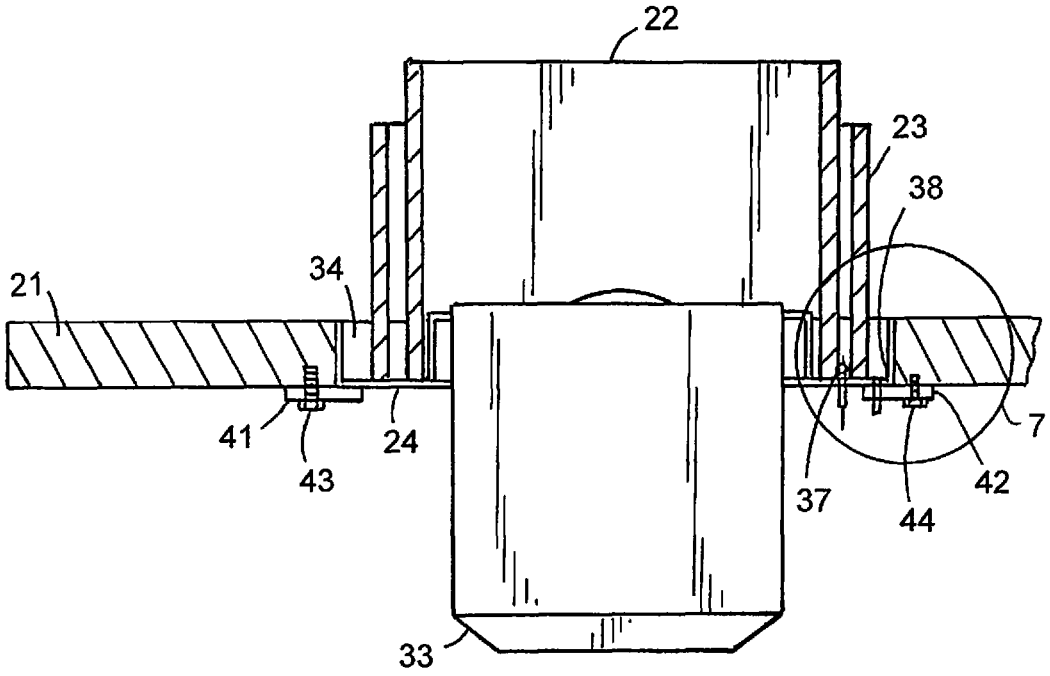
FIG. 6 is an enlarged sectional view taken along line 6-6 of FIG. 4.
Figure 7:
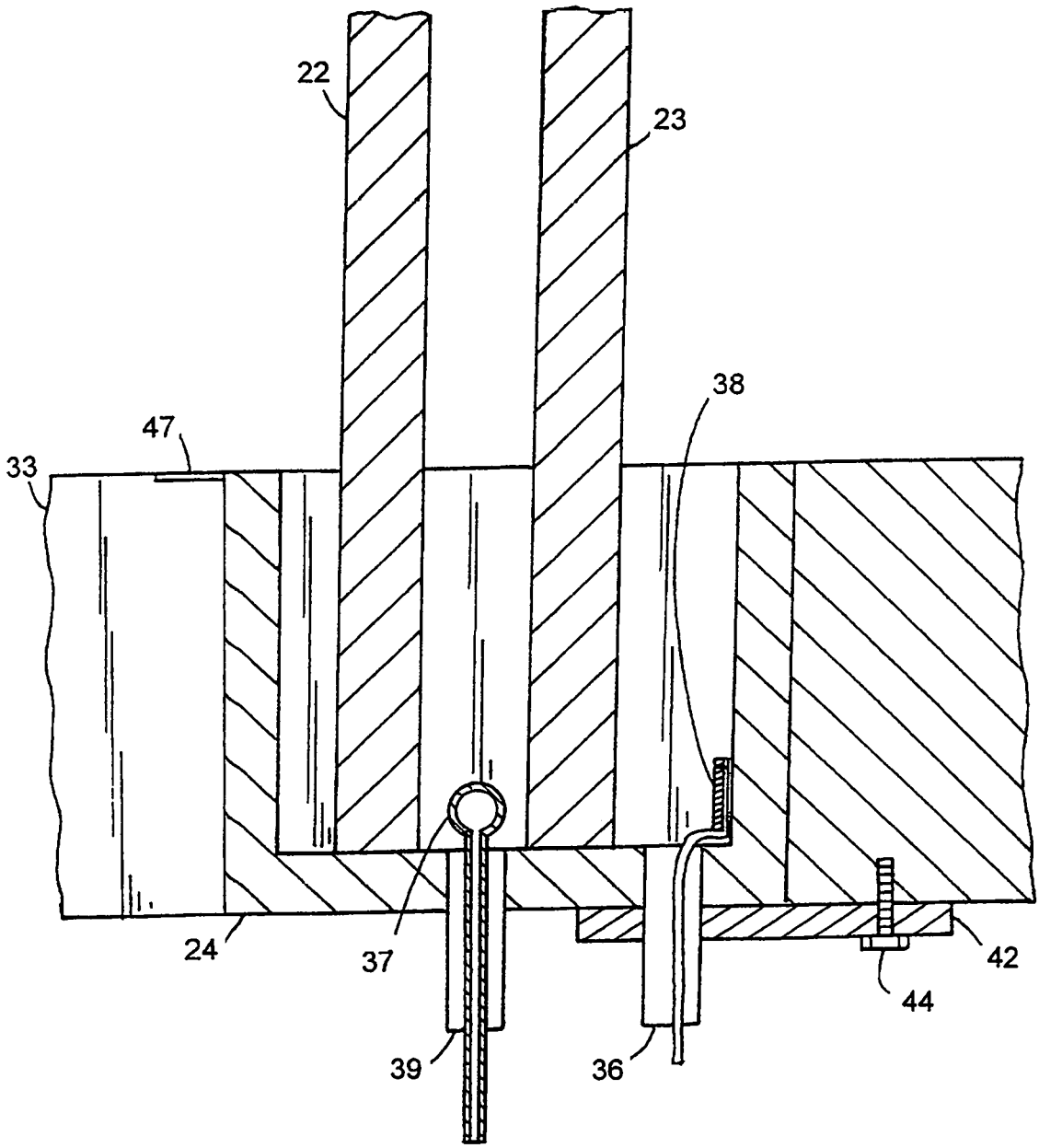
FIG. 7 is an enlarged sectional view of Area 7 of FIG. 6.
Figure 8:
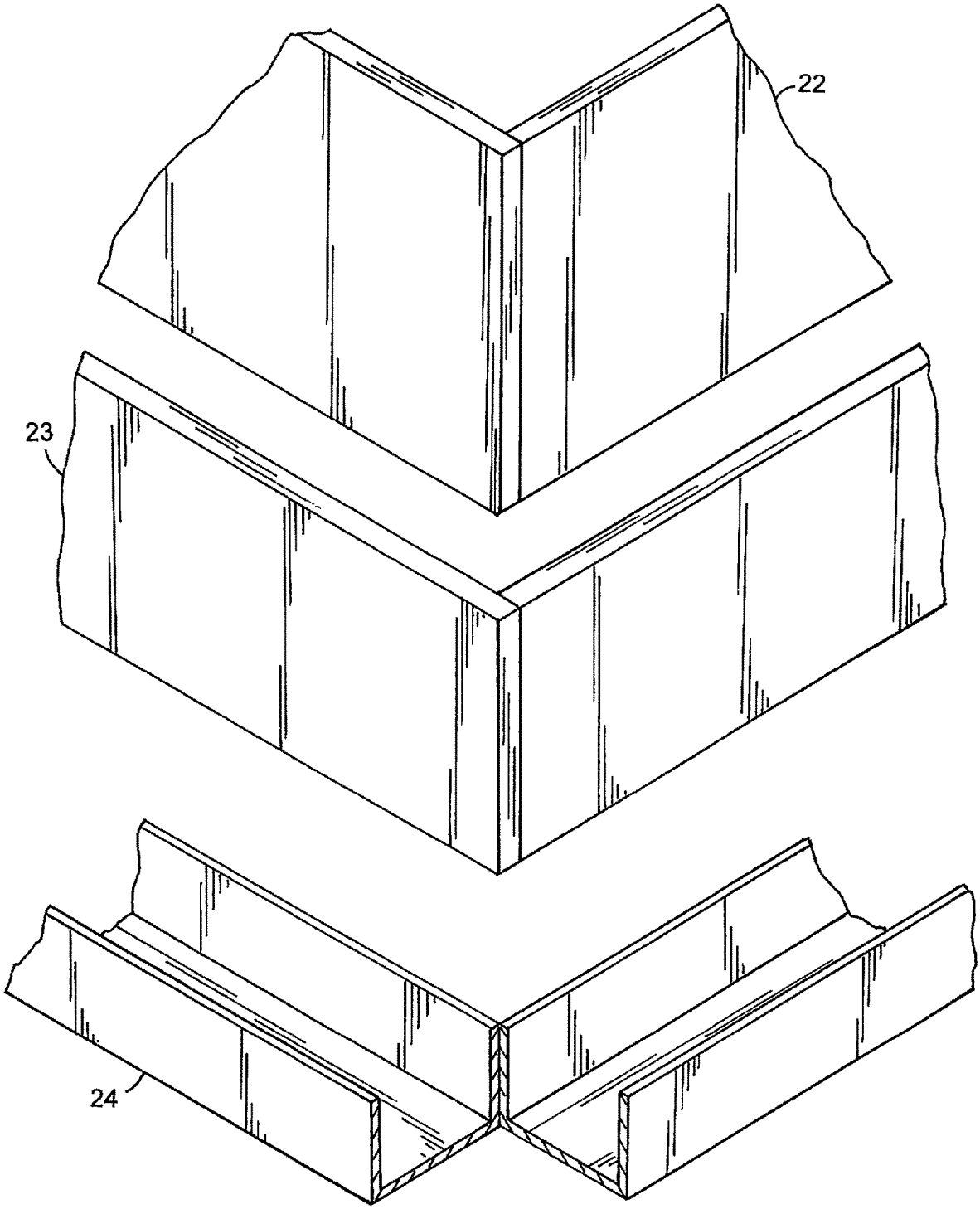
FIG. 8 is an exploded view of the wall assemblies of the aesthetic enhancement apparatus of FIG. 1.

Referring to FIGS. 1 to 8 there is shown an aesthetic enhancement apparatus indicated generally at 20 useable to create atmosphere and ambience in outdoor living spaces such as patios, backyards and the like. Aesthetic enhancement apparatus 20 is shown mounted to an elevated table top 21 having a generally flat upper surface with a central opening. Apparatus 20 can be mounted on or inserted into other types of tables and items such as retaining walls, outdoor fireplaces and countertops.

Aesthetic enhancement apparatus 20 has a channel shaped frame 24 adapted to fit within the central opening of table top 21. Ledges 41 and 42 projecting outwardly from the bottom of frame 24 adjacent the bottom of table top 21 are fastened to table top 21 with fasteners 43 and 44 to mount apparatus to table top 21.

Aesthetic enhancement apparatus 20 has inner and outer laterally spaced upright wall assemblies 22 and 23 joined to the bottom of frame 24 to define a chamber 26 for holding liquid such as water. Wall assemblies 22 and 23 each have end walls 27 and 28 and side walls 29 and 31 joined together to form generally rectangular-shaped members. Walls 27, 28, 29 and 31 are preferably panes of transparent tempered glass. Other materials can be used to construct walls 27, 28, 29 and 31. The end portions of end walls 27, 28 and side walls 29, 31 are sealed together with a sealant such as tape or adhesive to prevent water leakage between end walls 27, 28 and side walls 29, 31. Similarly, the bottom portions of end walls 27, 28 and side walls 29, 31 are sealed to the bottom of frame 24 with a sealant to prevent water leakage.

Inner wall assembly 22 has a generally uniform height that is greater than the height of outer wall assembly 23. Inner wall assembly 22 surrounds a chamber 32 containing a burner assembly 33 operable to generate a flame. Water located between inner and outer wall assemblies 22 and 23 is contained within chamber 26. Water is pumped into chamber 26 through tubes 39 open to the bottom of chamber 26. Water may spill and flow out of chamber 26 over outer wall assembly 23 when air bubbles are created in the water. Overflowing water drains into a channel 34 of frame 24 surrounding outer wall assembly 23 and out a tube 36 to a liquid reservoir located below table top 21. Inner wall assembly 22 being taller than outer wall assembly 23 prevents water from flowing out of chamber 26 into burner chamber 32 as the level of water in chamber 26 is limited to the height of outer wall assembly 23. Water in chamber 26 cools inner and outer wall assemblies 22 and 23 whereby outer wall assembly 23 is cool to the touch.

Burner assembly 33 is a generally rectangular shaped member located in chamber 32 surrounded by inner wall assembly 22. Burner assembly 33 has a pan-shaped base 35 adapted to accommodate fire resistant glass beads and the like. Flanges 46 and 47 extending outwardly from base 35 are fastened to frame 24 with fasteners to mount burner assembly 33 on frame 24.

Air from an air supply is pumped into a tube 37 located in the bottom of chamber 26. Tube 37 has a plurality of small openings to allow the release of air into the water in chamber 26 to form air bubbles in the water that move rapidly upwardly to the top surface of the water.

A light strip 38 such as a LED waterproof light strip located along the bottom of channel 34 is operable to illuminate inner and outer wall assemblies 22 and 23, the water in chamber 26 and the air bubbles moving through the water in changing colors. Light strip 38 extends from a power supply through tubes 36 in frame 24 into channel 34. Light emanating from light strip 38 and burner assembly 33 reflects off air bubbles, water, glass beads and wall assemblies 22 and 23 in a dissimilar manner to create ambience and a relaxing atmosphere.

Figure 9:
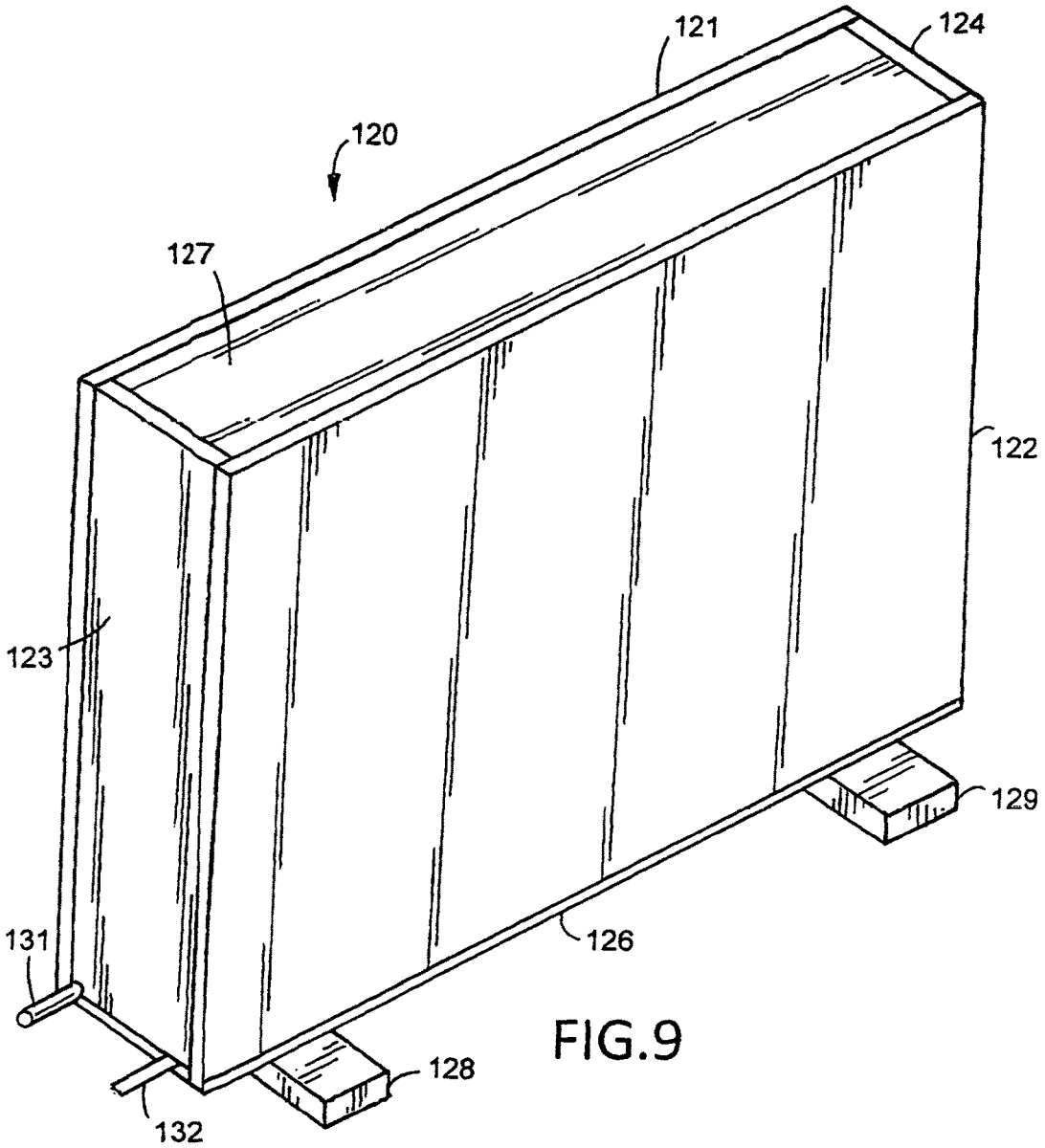
FIG. 9 is a perspective view of a modification of the aesthetic enhancement apparatus.
Figure 10:
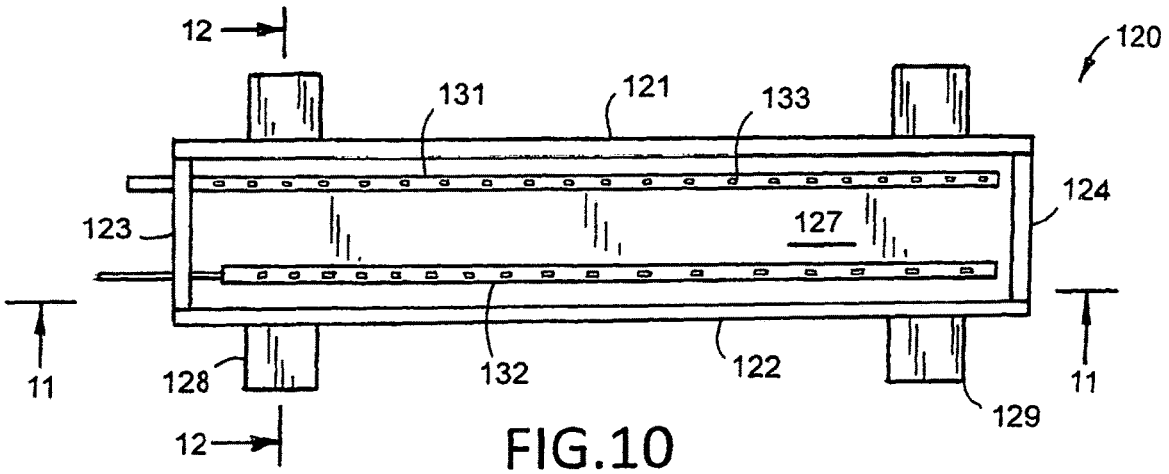
FIG. 10 is a top plan view of FIG. 9.
Figure 11:
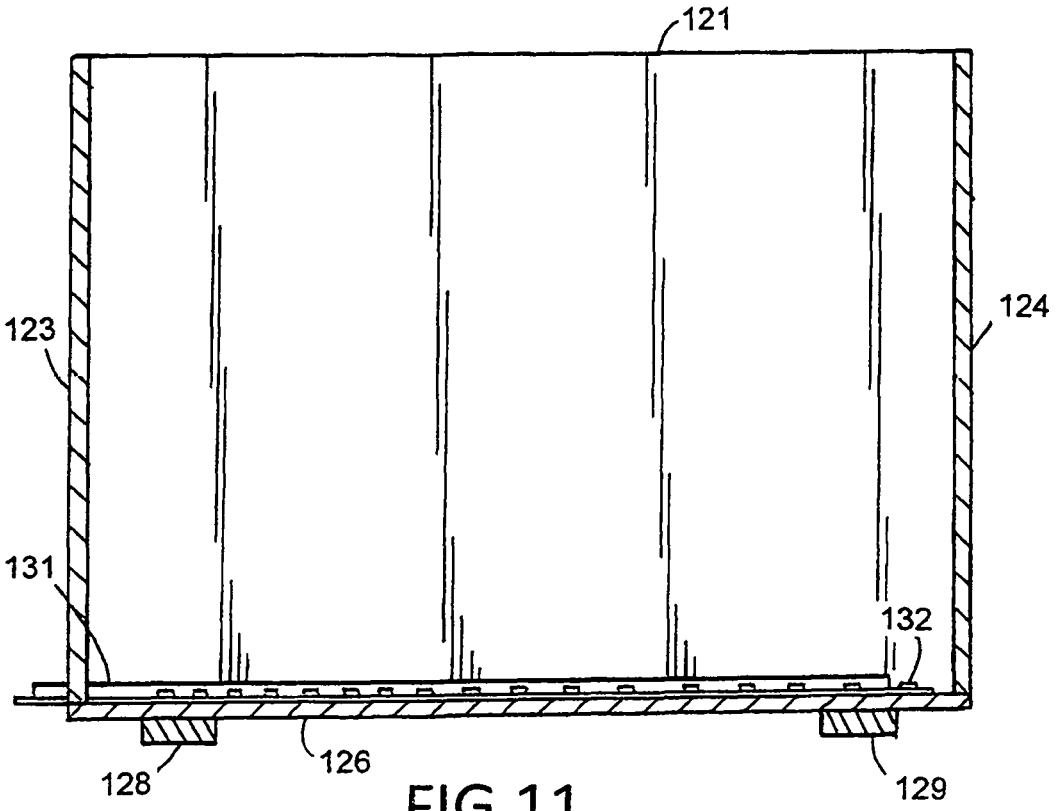
FIG. 11 is an elevated front view of FIG. 9.
Figure 12:
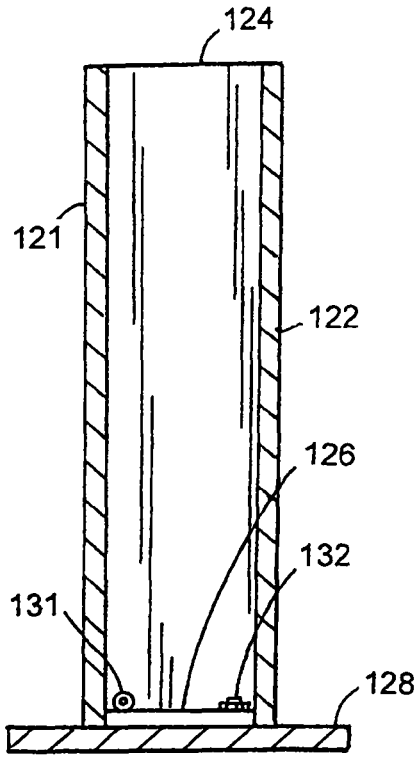
FIG. 12 is an elevated end view of FIG. 9.

A first modification of the aesthetic enhancement apparatus indicated generally at 120, is shown in FIGS. 9 to 12. Aesthetic enhancement apparatus 120 is useable to create atmosphere and ambience in outdoor and indoor living spaces. Apparatus 120 is a free standing portable unit that can be moved around a living space or stored in a storage area, if desired.

Aesthetic enhancement apparatus 120 has laterally spaced upright side walls 121 and 122 joined to end walls 123 and 124 and bottom wall 126 to define an inner chamber 127 for holding liquid such as water. Walls 121, 122, 123 and 124 are preferably panes of transparent tempered glass. Other materials can be used to construct walls 121-124. Side walls 121 and 122, end walls 123 and 123 and bottom wall 126 are sealed together to prevent water leakage from chamber 127. Supports 128 and 129 attached to bottom wall 126 extending outwardly from side walls 121 and 122 stabilize and retain apparatus 120 in an upright position.

An air tube 131 extends through end wall 123 of apparatus 120 into the bottom of chamber 127. Air is pumped from an air supply into tube 131. Tube 131 has a plurality of openings 133 to allow the release of air into the water in chamber 127 thereby forming air bubbles in the water that move upwardly to the top surface of the water.

A light strip 132 such as a waterproof LED light strip extends through end wall 123 of apparatus 120 into the bottom of chamber 127 adjacent tube 131. Light strip 132 is operable to illuminate walls 121-124, water in chamber 127 and the air bubbles moving through the water. Light from light strip 132 reflects off walls 121-124, water and air bubbles in a dissimilar manner to create ambience and a relaxing atmosphere.

The foregoing disclosure of the invention describes and illustrates a plurality of embodiments of the aesthetic enhancement apparatus of the invention. Modifications, changes in parts, arrangement of parts, materials and method operation may be made to the aesthetic enhancement apparatus and method defined in the claims herein by persons skilled in the art without departing from the invention.

The invention claimed is:

1. A method of aesthetically enhancing a living space comprising:

providing a first transparent upright wall assembly and a second transparent upright wall assembly laterally spaced from the first transparent upright wall assembly, joining the first and second upright wall assemblies to a frame member to define a liquid chamber for holding a liquid, mounting the frame member on an elevated support surface, sealing adjacent end portions of the first and second upright wall assemblies and frame member to prevent leakage of liquid from the liquid chamber, mounting a burner assembly on the frame member, surrounding the burner assembly with the first and second upright wall assemblies to define a burner chamber, creating a flame in the burner chamber with the burner assembly, moving liquid into the liquid chamber between the first and second upright wall assemblies, locating a portion of the flame below a top surface of the liquid in the liquid chamber, releasing air from an air supply into the liquid to form air bubbles in the liquid, draining excess liquid from the liquid chamber, and locating a light source in the liquid chamber, the light source connected to a power source, the light source operable to illuminate the first and second upright wall assemblies, the liquid in the liquid chamber and the air bubbles in the liquid whereby the portion of the flame is visible in the burner chamber through the first and second upright wall assemblies, the liquid in the liquid chamber and the air bubbles in the liquid.

2. The method of claim 1 including:

providing an air tube connected to the air supply, the air tube located in the liquid chamber, the air tube having a plurality of openings to allow air from the air supply to be released into the liquid and form air bubbles.

3. The method of claim 1 wherein:

the light source is a LED waterproof light strip located within the liquid chamber.

4. The method of claim 1 wherein:

the first upright wall assembly and the second upright wall assembly each have a uniform height.

5. The method of claim 1 including:

limiting a level of the liquid in the liquid chamber to prevent liquid from flowing out of the liquid chamber and into the burner chamber and the burner assembly.

6. The method of claim 1 wherein:

the elevated support surface is a table top having a central opening, and mounting the frame member within the opening whereby the first and second upright wall assemblies are elevated above the table top and the burner assembly.

7. The method of claim 1 including:

providing an overflow tube member connected to a liquid reservoir to drain the excess liquid from the liquid chamber into the liquid reservoir.

8. A method of aesthetically enhancing a living space comprising:

providing a first transparent upright wall assembly and a second transparent upright wall assembly laterally spaced from the first transparent upright wall assembly, joining the first and second upright wall assemblies to a frame member to define a chamber for holding a liquid, mounting the frame member on an elevated support surface, sealing adjacent end portions of the first and second upright wall assemblies and frame member to prevent leakage of liquid from the chamber, mounting a burner assembly on the frame member, surrounding the burner assembly with the first and second upright wall assemblies, creating a flame with the burner assembly, moving liquid into the chamber between the first and second upright wall assemblies, locating a portion of the flame below a top surface of the liquid in the chamber whereby the flame is visible through the first and second upright wall assemblies and the liquid in the chamber, releasing air from an air supply into the liquid to form air bubbles in the liquid, and illuminating the first and second upright wall assemblies, the liquid in the chamber and the air bubbles in the liquid.

9. The method of claim 8 including:

providing an air tube connected to the air supply, the air tube located in the chamber, the air tube having a plurality of openings to allow air from the air supply to be released into the liquid and form air bubbles.

10. The method of claim 8 including:

locating a light source in the chamber, the light source connected to a power source, the light source operable to illuminate the first and second upright wall assemblies, liquid in the chamber and air bubbles in the liquid.

11. The method of claim 10 wherein:

the light source is a LED waterproof light strip located within the chamber.

12. The method of claim 8 wherein:

the first upright wall assembly and the second upright wall assembly each have a uniform height.

13. The method of claim 8 including:

limiting a level of the liquid in the chamber to prevent liquid from flowing out of the chamber and into the burner assembly.

14. The method of claim 8 wherein:

the elevated support surface is a table top having a central opening, and mounting the frame member within the opening whereby the first and second upright wall assemblies are elevated above the table top and the burner assembly.

15. The method of claim 8 including:

providing an overflow tube member connected to a liquid reservoir to drain excess liquid from the chamber into the liquid reservoir.

16. A method of aesthetically enhancing a living space comprising:

providing a first transparent tempered glass upright wall assembly and a transparent tempered glass second upright wall assembly laterally spaced from the first transparent tempered glass upright wall assembly, joining the first and second upright wall assemblies to a frame member to define a chamber for holding a liquid, mounting the frame member on an elevated support surface, sealing adjacent end portions of the first and second upright wall assemblies and frame member to prevent leakage of liquid from the chamber, mounting a burner assembly on the frame member, surrounding the burner assembly with the first and second upright wall assemblies, creating a flame with the burner assembly, moving liquid into the chamber between the first and second upright wall assemblies, locating a portion of the flame below a top surface of the liquid in the chamber whereby the flame is visible through the first and second upright wall assemblies and the liquid in the chamber, providing an air tube connected to an air supply, the air tube located in the chamber, the air tube having a plurality of openings to allow air from the air supply to be released into the liquid and form air bubbles, limiting a level of the liquid in the chamber to prevent liquid from flowing out of the chamber and into the burner assembly, providing an overflow tube member connected to a liquid reservoir to drain excess liquid from the chamber into the liquid reservoir, providing a light source connected to a power source, the light source operable to illuminate the first and second upright wall assemblies, the liquid in the chamber and the air bubbles in the liquid, the light source including a LED waterproof light strip located within the chamber.

17. The method of claim 16 wherein:

the first upright wall assembly and the second upright wall assembly each have a uniform height.

18. The method of claim 16 wherein:

the elevated support surface is a table top having a central opening, and mounting the frame member within the opening the first and second upright wall assemblies being elevated above the table top and the burner assembly.

* * * * *